United States Patent [19]

Oldford

[11] 4,236,289

[45] Dec. 2, 1980

[54] APPARATUS AND METHOD FOR FABRICATING PULLEYS

[75] Inventor: William G. Oldford, Lexington, Mich.

[73] Assignee: Huron Tool & Manufacturing Division of U.S. Industries, Inc., Lexington, Mich.

[21] Appl. No.: 5,167

[22] Filed: Jan. 22, 1979

Related U.S. Application Data

[62] Division of Ser. No. 813,165, Jul. 5, 1977, Pat. No. 4,138,776.

[51] Int. Cl.[3] ..... B21K 1/42

[52] U.S. Cl. ..... 29/159 R; 72/381; 72/386

[58] Field of Search ..... 29/159 R, 159.1; 72/354, 381, 384, 386; 113/116 D, 116 V

[56] References Cited

U.S. PATENT DOCUMENTS

| | | | |
|---|---|---|---|
| 3,440,705 | 4/1969 | Johnson | 29/159 R |
| 3,851,366 | 12/1974 | Jacobs | 29/159 R |
| 3,893,818 | 7/1975 | Mickus | 29/159 R |
| 4,069,572 | 1/1978 | Pierce et al. | 29/159 R |
| 4,129,026 | 12/1978 | Pierce et al. | 113/116 D |

*Primary Examiner*—Ervin M. Combs

*Attorney, Agent, or Firm*—Harness, Dickey & Pierce

[57] ABSTRACT

There is disclosed herein a method and apparatus for fabricating a pulley in which the pulley rim is fabricated from a cylindrically-shaped blank of constant diameter which is deformed by relatively movable die forming members so as to form a ring having a V-shaped cross section which may then be assembled to a hub member. Auxiliary forming dies are also disclosed which may assist in the proper formation of the V-shaped cross section. In another form, the pulley rim is fabricated with multiple annular V-grooves. Apparatus effective for carrying out the above method is also disclosed herein.

5 Claims, 11 Drawing Figures

Fig. 1.
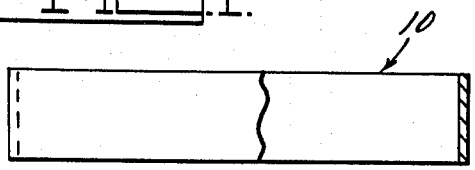
Fig. 3.
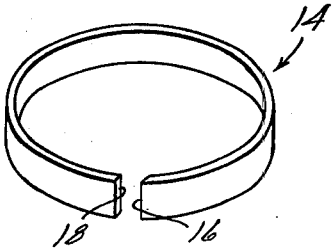
Fig. 4.
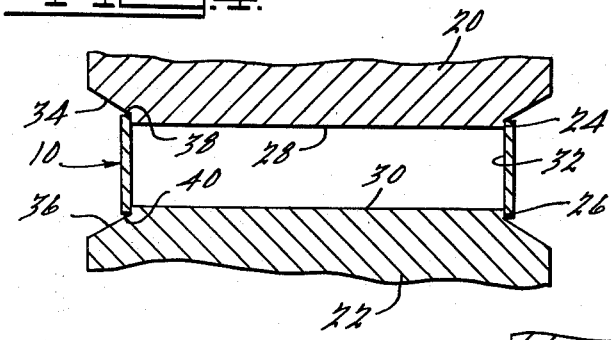
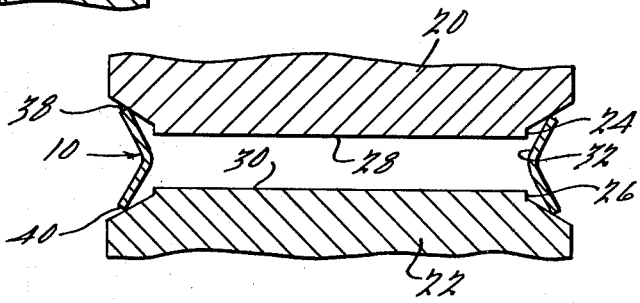
Fig. 5.
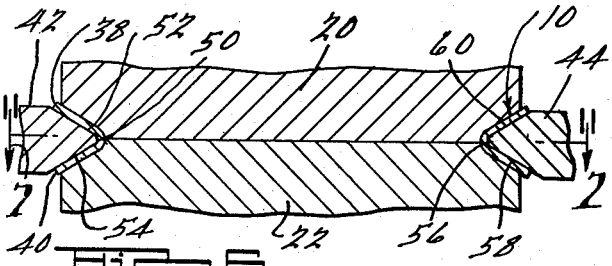
Fig. 6.
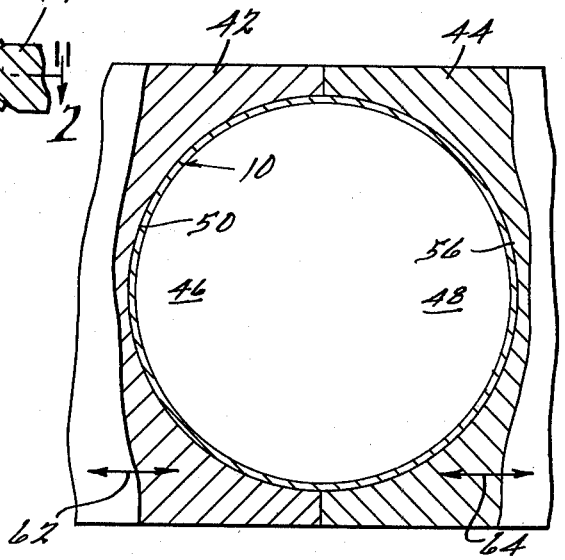
Fig. 7.

APPARATUS AND METHOD FOR FABRICATING PULLEYS

This is a division of application Ser. No. 813,165, filed July 5, 1977, now U.S. Pat. No. 4,138,776.

BACKGROUND AND SUMMARY OF THE INVENTION

The present invention relates generally to pulleys and pulley constructions and more particularly to methods and apparatus for fabricating pulleys.

Numerous methods have been developed for fabricating pulleys of different sizes and shapes including such diverse methods as casting, stamping, rolling, spinning or combinations thereof. A commonly employed method involves a stamping operation in which a pulley is fabricated from sheet stock by progressive dies. While this operation produces an acceptable pulley construction, substantial amounts of waste material result from both the trimming operation necessary to obtain a circular blank as well as from punching or drilling operations necessary to provide shaft or other mounting provisions in the hub portion thereof. Further, additional material is required as generally one of the V-groove defining walls will be double thickness. Thus, the additional material required must necessarily result in increased costs of producing such pulleys. Such costs are similarly present in those operations which combine stamping and rolling operations. Further, when a rolling operation is included, additional machine set up time is required in order to properly index the roller advancing mechanisms as well as requiring additional labor to properly maintain these mechanisms.

Another method commonly employed in fabricating pulleys involves a slitting operation in which flat stock is blanked into discs which are then provided with a circumferential V-groove by slitting the edge around the circumference and forming these slit portions axially outward to thereby define a V-groove therebetween. While this method avoids the extra material required by the double wall thickness in the stamping operation, it nevertheless still is a relatively expensive construction due to the increased maintenance costs associated with the required cutters.

The present invention, however, provides a pulley construction method and apparatus for executing the method which enables maximum flexibility in design strength for both the rim portion and, hub portion thereby allowing fabrication of pulleys having sufficient strength to accomplish their intended function while avoiding the added cost of excessive structural strength in other portions. Further, as the present invention utilizes cylindrically-shaped blanks for fabrication of the pulley rim, all waste is substantially eliminated. Also, the apparatus for forming a pulley by the method of the present invention is less complex and therefore not only less expensive but more easily maintained and less subject to unexpected downtime. Further, production may be easily shifted from one side pulley rim to another by merely exchanging dies on the machine.

Additional advantages and features of the present invention will become apparent from the subsequent description and the appended claims taken in conjunction with the accompanying drawings.

BRIEF DESCRIPTION OF THE DRAWINGS

FIG. 1 is an elevational view of a pulley rim blank having a portion thereof broken away;

FIG. 3 is a perspective view of an alternative means for fabricating a pulley rim blank from strip stock in accordance with the present invention;

FIG. 4 is a sectional view of a pulley rim blank shown in operative relationship to forming means in preparation for a forming operation;

FIG. 5 is a sectional view similar to that of FIG. 4 showing the forming members in a partially closed position with a pulley ring blank partially formed;

FIG. 6 is a sectional view similar to that of FIGS. 4 and 5 showing the forming means in a fully closed position having completed forming pulley blank and alternative auxiliary forming means in operative relationship thereto;

FIG. 7 is a sectional view illustrating the auxiliary forming members in a fully closed position, the section being taken along line 7—7 of FIG. 6;

DESCRIPTION OF THE PREFERRED EMBODIMENTS

Figure 8:
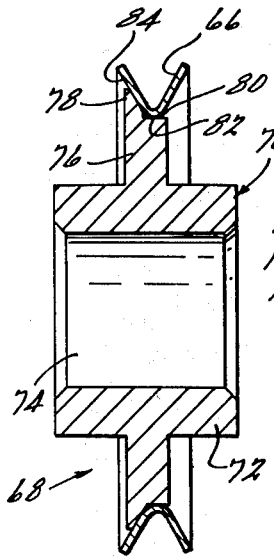
FIG. 8 is a sectional view of a pulley construction including a pulley rim all in accordance with the present invention.

Referring now to FIG. 1, there is illustrated therein a cylindrical pulley rim blank 10 having a diameter equal to the root or minimum diameter of a pulley to be fabricated therefrom and a width substantially equal to the transverse surface length of the resulting V-groove pulley rim. Pulley rim blank 10 may be of any suitable material such as steel and will have a thickness suitable to afford a sufficient rigidity to the converging sidewalls defining the V-groove of the pulley construction. Pulley rim blank 10 will preferably be obtained by severing sections of a suitable width from a cylindrical hollow tube member 12 such as is illustrated in FIG. 3 or in the alternative from a generally rectangular elongated strip 14 of a suitable material by bringing the longitudinal ends 16 and 18 thereof into abutting relationship and securing them together such as by welding or brazing. In either event, a generally cylindrical shape member is obtained which provides a suitable blank for the fabrication of a pulley rim.

As illustrated in FIG. 4, a pair of relatively movable upper and lower forming means 20 and 22 are provided which when in an open position are adapted to receive pulley rim blank 10 therebetween. Forming means 20 and 22 are generally cylindrical in shape and are each provided with a relatively small annular shoulder portion 24 and 26 respectively adjacent end portions 28 and 30 which are adapted to engage an interior surface 32 of pulley rim blank 10 so as to accurately position pulley rim blank 10 in position prior to commencement of the forming operation. Annular beveled surfaces 34 and 36 are provided extending generally radially outward and axially away from respective end portions 28 and 30 of forming members 20 and 22.

Thus, in order to form a pulley rim from pulley rim blank 10, pulley rim blank 10 is first inserted between the relatively movable forming members 20 and 22 with opposing circumferential edge portions 38 and 40 engaging the radially inner end of respective beveled surfaces 34 and 36. Relatively movable forming members 20 and 22 are then caused to approach one another thereby causing circumferential edge portions 38 and 40 of the pulley rim blank 10 to be deformed in a radial outward direction along beveled surfaces 34 and 36 thereof. As seen in FIG. 5, the deformation of the circumferential edge portions 38 and 40 is in both a radially outward direction and axially converging direction. That is, opposite circumferential edge portions 38 and 40 are brought into closer relationship relative to each other. Once upper and lower forming members 20 and 22 are fully closed, pulley rim blank member 10 will have been formed into an annular ring having a generally V-shaped cross section.

However, in some applications it may be desirable to provide additional insurance that pulley rim blank 10 has properly assumed the desired V-shaped cross sectional configuration. Thus, an additional pair of relatively movable die forming means 42 and 44 may be provided such as illustrated in FIGS. 6 and 7. As seen therein, die forming means 42 and 44 are each provided with a semicircular cut out portion 46 and 48 respectively which, when die members 42 and 44 are in a closed position, define a circular opening therebetween. Cut out portion 46 of die member 42 is defined by a radiused nose portion 50 and radially outwardly extending diverging sidewall portions 52 and 54. Cut out portion 48 of die member 44 is similarly defined by radiused nose portion 56 and radially outwardly extending diverging sidewall portions 58 and 60. Die members 42 and 44 are radially movable with respect to pulley rim blank 10 in the directions indicated by arrows 62 and 64. When die members 42 and 44 are in a closed position, cut out portions 46 and 48 will define a cylindrical opening having a minimum diameter located substantially at the point of engagement of surfaces 28 and 30 of upper and lower forming members 20 and 22. Diverging upper and lower sidewall portions will cooperate with the beveled surfaces 34 and 36 of upper and lower forming members 20 and 22 to insure accurate formation of a pulley rim V-groove.

In a preferred operational sequence, upper and lower relatively movable forming members 20 and 22 will first be brought into mutual engagement and thereafter auxiliary die members 42 and 44 may be moved inwardly so as to insure that surface 32 of pulley rim blank 10 has fully seated along surfaces 24, 26, 34, and 36 of upper and lower forming members 20 and 22. It should be noted, however, that while only two radially movable forming members 42 and 44 have been described and illustrated herein each being provided with a semicircular cut out portion 46 and 48 respectively, the circular opening defined thereby may be provided by any desired number of die forming members for example four such members each having a quarter circular cut out portion.

Figure 9:
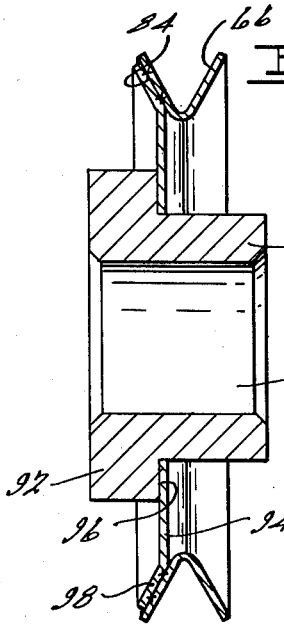
FIG. 9 is a sectional view of an alternative embodiment of a pulley including a pulley rim in accordance with the present invention.
Figure 2:
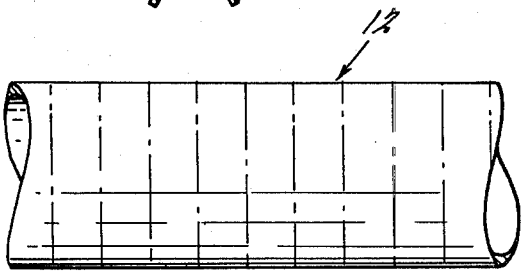
FIG. 2 is an elevational view of a hollow cylindrical member from which a plurality of pulley rim blanks may be severed.

Once the pulley rim blank 10 has been formed in the manner as described with reference to FIGS. 4 through 7 above, the pulley itself may be completed by mounting formed rim member 66 on a suitably designed hub member such as is illustrated in FIGS. 8 and 9. As shown in FIG. 8, a pulley 68 constructed in accordance with the present invention includes a hub member 70 having a central portion 72 which includes an axial base 74 for mounting pulley 68 to a shaft and a generally annularly outwardly extending flange portion 76 having an inclined outer circumferential edge portion 78 and an annular radially outwardly facing stepped portion 80. Inclined portion 78 and stepped portion 80 are adapted to provide a suitable surface for engagement with a nose portion 82 and inclined sidewall portion 84 of the pulley rim member 66. Pulley rim member 66 may be easily secured to hub member 70 in any suitable manner such as by brazing, welding or even by a suitable adhesive should this be desired such as for example if hub member 70 is fabricated from a plastic material.

An alternative pulley construction in accordance with the present invention is illustrated at 86 in FIG. 9 in which there is provided a central hub member 88 having an axial passage 90 therethrough so as to enable the pulley to be secured to a suitable shaft or the like and a radially outwardly extending annular flange portion 92. A radially outwardly projecting ring-like member 94 is secured to an axially facing surface 96 of flange portion 92 and has an inclined outer surface portion 98 to which a sidewall portion 84 of the pulley rim member 66 may be easily secured. As previously mentioned, pulley rim member 66 may be secured to portion 98 in a suitable manner such as by copper brazing, welding or even a suitable adhesive. Similarly, member 94 may be secured to surface 96 in like manner or should it be desired by bolting thereto.

Figure 10:
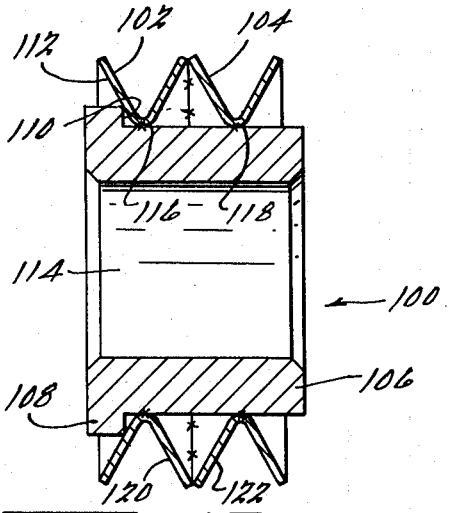
FIG. 10 is a sectional view illustrating another embodiment of a pulley construction in accordance with the present invention.

Referring now to FIG. 10, yet another embodiment of a pulley construction 100 in accordance with the present invention is illustrated therein. In this embodiment, two pulley rim members 102 and 104 are secured to a single central hub member 106. Central hub member 106 comprises a generally cylindrical shaped member having a radially outwardly extending flange portion 108 adjacent one end thereof which provides an axially facing shoulder 110 adapted to engage a sidewall portion 112 of rim member 102 so as to provide stability thereto during and after assembly. An axial passage 114 is also provided within the central hub member for enabling the pulley construction to be mounted upon a shaft or the like. Pulley rim members 102 and 104 are substantially identical and are each secured directly to the central hub member at the point of engagement of nose portions 116 and 118 and have adjacent outwardly disposed sidewall portions 120 and 122 secured in mutually engaging relationship such as by copper brazing and/or spot welding therealong.

Figure 11:
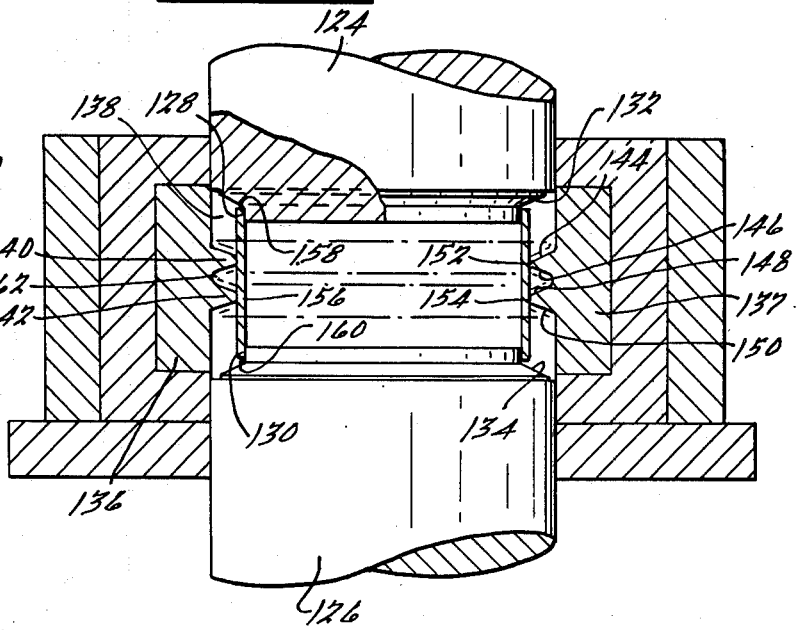
FIG. 11 is a partially sectioned elevational view of a modified forming means in an open position adapted for forming a double V-groove pulley having a pulley rim blank disposed therein in preparation for a forming operation.

While the pulley construction 100 of FIG. 10 may be fabricated by separately assembling two individually formed pulley rim members 102 and 104 thereto, an alternative means for forming a single pulley rim member having multiple V-grooves provided thereon is illustrated in FIG. 11. In this embodiment a pair of relatively movable upper and lower die forming members 124 and 126 are provided which are substantially identical to the die forming members illustrated and described with reference to FIGS. 4 through 6 above, each including annular stepped portions 128 and 130 and radially outwardly extending beveled surfaces 132 and 134. However, in this case auxiliary die members 136 and 137 are provided which when in a closed position define a generally cylindrically shaped opening 138 through which upper and lower forming members 124 and 126 move and which is provided with a pair of radially inwardly extending projections 140 and 142. Projections 140 and 142 are each defined by an upper and lower (as viewed in FIG. 11) radially inwardly converging sidewalls 144, 146, 148, and 150 respectively and radiused interconnecting portions 152 and 154 respectively. A suitable pulley rim blank 156 is disposed in position between upper and lower forming members 124 and 126 with opposing circumferential edge portions 158 and 160 engaging beveled surfaces 132 and 134 respectively in preparation for the forming operation to be performed thereon. Thus, as upper and lower forming members 124 and 126 are moved together, the circumferential edge portions 158 and 160 of pulley rim blank member 156 are caused to deform radially outwardly and axially toward each other while a center portion thereof is caused to deform radially outwardly into the recess 162 between the upper and lower radially inwardly extending projections 140 and 142. In operation, it may be desirable to provide a cylindrically shaped center projection of a diameter substantially equal to the pulley rim blank member extending between and telescopically received within one or both of upper and lower forming members 124 and 126 so as to provide a suitable backing to prevent radial inward buckling as the pulley rim blank is formed. Once pulley rim blank 156 has been completely formed, upper and lower die forming members 124 and 126 as well as auxiliary die members 136 and 137 will withdraw from their closed position thereby enabling removal of the completed pulley rim member and allowing insertion of a new blank. The completed pulley rim may then be assembled to a hub member in a like manner as described above.

Thus, as is apparent there is illustrated herein a method and apparatus for forming a pulley rim member which may be easily assembled to a central hub member so as to form a durable pulley construction of any desired size which may be rapidly formed by a single press operation. Further, as the present construction does not require the use of rollers or cutters in forming the V-groove, set up time may be reduced as well as maintenance in that roller or cutter advance mechanisms need not be adjusted or maintained. Also, production may be easily switched between different sized pulley rims by merely switching die members. Further, in that the pulley rim members are fabricated separately from the hub members, it is a relatively simple matter to produce a mixture of pulley rim diameters which may accommodate various shaft diameters. Also, in that the method of the present invention employs blanks of a cylindrical shape which may be easily obtained by slicing tube stock or from strip stock, substantially all material waste is eliminated. Thus, the method and apparatus of the present invention enables substantial flexibility in fabricating pulleys of various sizes, enables relatively inexpensive and rapid fabrication thereof with substantially no waste while still providing a strong, durable pulley construction.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. Apparatus for forming a pulley comprising:

first forming means for receiving and supporting a circumferential edge portion of a cylindrical pulley rim blank;

second forming means axially opposed to said first forming means for engaging another circumferential edge portion of said pulley rim blank;

said first and second forming means being generally cylindrical and having an annular shoulder portion on an axially opposed end thereof to engage and accurately locate the interior surface of said rim blank with respect to said forming means; and said first and second forming means being relatively movable along the axis of said pulley rim blank so as to cause said circumferential edge portions to be convergingly deformed.

2. Apparatus as set forth in claim 1 wherein said first and second forming means each have an annular beveled edge portion, said edge portion engaging said pulley rim blank so as to cause radially outwardly and axially converging deformation of said circumferential edge portions.

3. Apparatus as set forth in claim 1 further comprising radially movable forming means, said radially movable forming means being adapted to deform a central annular portion of said pulley rim blank in a radial inward direction.

4. Apparatus as set forth in claim 3 wherein said radially movable forming means comprises at least first and second die members having pulley rim engaging edge portion defined by radially outwardly diverging sidewalls and edge portions which define a generally circular opening when said die members are in a closed position.

5. Apparatus as set forth in claim 3 wherein said radially movable forming means comprises at least first and second die members which define a generally cylindrical opening having a pair of adjacent annular radially inwardly extending projections defined by radially inwardly axially converging sidewalls, said first and second forming means and said first and second die members cooperating to deform said pulley rim blank into a pulley rim having a double V-groove.

* * * * *